US009641927B2

(12) United States Patent
Fernandez-Medina et al.

(10) Patent No.: US 9,641,927 B2
(45) Date of Patent: May 2, 2017

(54) ANTENNAS SUITABLE FOR WIRELESS EARPHONES

(71) Applicant: QUALCOMM TECHNOLOGIES INTERNATIONAL, LTD., Cambridge (GB)

(72) Inventors: Pablo Fernandez-Medina, Cambridge (GB); Leslie David Smith, Ely (GB)

(73) Assignee: Qualcomm Technologies International, Ltd., Cambridge (GB)

( * ) Notice: Subject to any disclaimer, the term of this patent is extended or adjusted under 35 U.S.C. 154(b) by 195 days.

(21) Appl. No.: 14/594,518

(22) Filed: Jan. 12, 2015

(65) Prior Publication Data

US 2016/0205461 A1 Jul. 14, 2016

(51) Int. Cl.

| | |
|---|---|
| ***H04R 1/10*** | (2006.01) |
| ***H01Q 1/24*** | (2006.01) |
| ***H01Q 1/27*** | (2006.01) |
| ***H01Q 7/00*** | (2006.01) |
| ***H04R 5/033*** | (2006.01) |

(52) U.S. Cl.

CPC ..... *H04R 1/1091* (2013.01); *H01Q 1/243* (2013.01); *H01Q 1/273* (2013.01); *H01Q 7/00* (2013.01); *H04R 1/1016* (2013.01); *H04R 5/033* (2013.01); *H04R 2420/07* (2013.01)

(58) Field of Classification Search

CPC ..... H04R 1/1091; H04R 5/00; H04R 25/00; H04R 2420/07; H04R 1/1016; H04R 5/033; H01Q 1/243; H01Q 1/273; H01Q 7/00

USPC ..... 381/74, 23.1, 60; 343/728, 732, 866

See application file for complete search history.

(56) References Cited

U.S. PATENT DOCUMENTS

| | | | | |
|---|---|---|---|---|
| 7,342,539 | B2 | 3/2008 | Rosenberg et al. | |
| 7,397,441 | B1 * | 7/2008 | Zweers | H01Q 1/243 343/702 |
| 7,652,628 | B2 | 1/2010 | Zweers | |
| 2008/0056526 | A1 | 3/2008 | Dunn et al. | |

OTHER PUBLICATIONS

International Search Report and Written Opinion—PCT/EP2016/050353—ISA/EPO—Apr. 11, 2016.

* cited by examiner

*Primary Examiner* — David Ton
(74) *Attorney, Agent, or Firm* — Paradice and Li LLP

(57) ABSTRACT

A wireless earphone designed to direct creeping waves around a wearer's head in a preferred direction.

17 Claims, 11 Drawing Sheets

ANTENNAS SUITABLE FOR WIRELESS EARPHONES

FIELD

The invention relates to wireless earphones.

BACKGROUND

Headphones for locating portable speakers adjacent to a person's ears for the enjoyment of music and the like are well known. Headphones which receive wireless signals conveying the sounds that are to be reproduced are also known. A wireless in-ear device is an enabling technology to allow the monitoring of body functions such as fitness trackers and heart-rate monitors. This data can be requested and displayed typically by another radio device such as a smartphone.

SUMMARY OF THE INVENTION

The invention is defined by the appended claims, to which reference should now be made.

BRIEF DESCRIPTION OF THE DRAWINGS

By way of example only, certain embodiments of the invention will now be described with reference to the accompanying drawings, in which.

DETAILED DESCRIPTION

Figure 1:
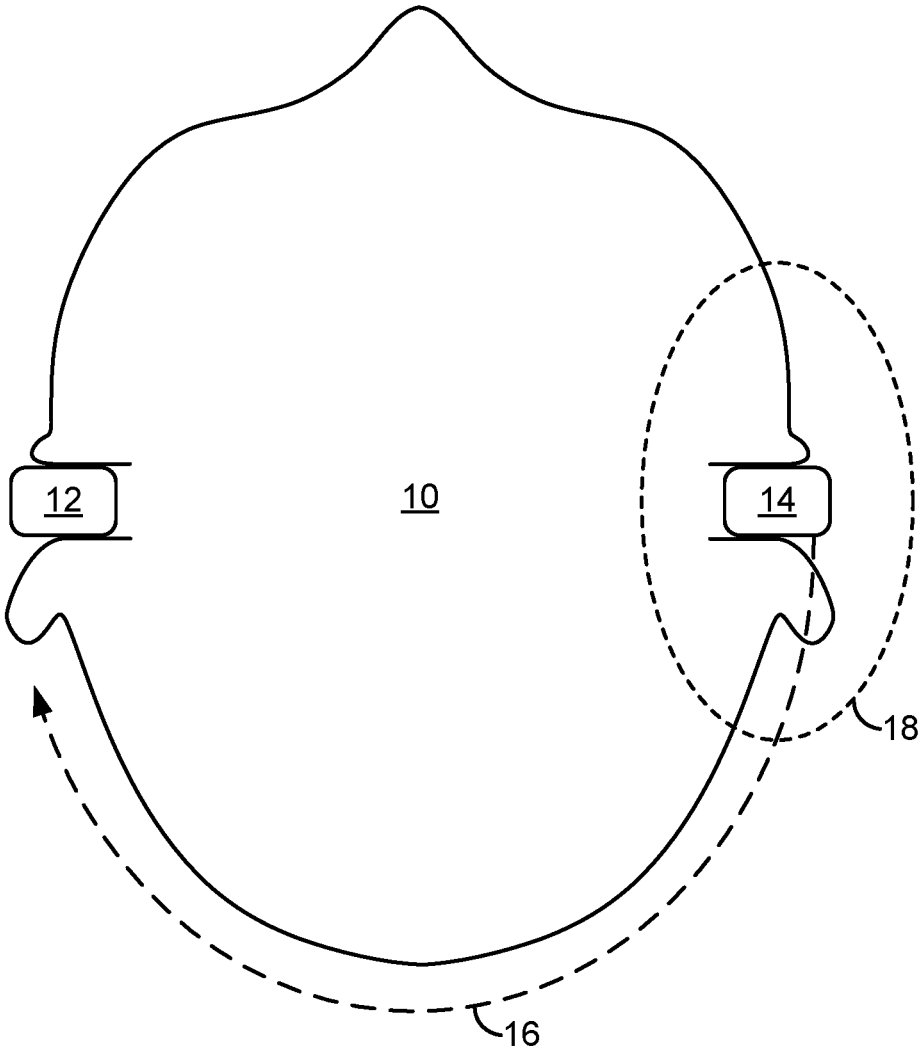
FIG. 1 is a cross section through the head of a person who is wearing a pair of in-ear earphones.

FIG. 1 shows a cross section through the head 10 of a person who is wearing a pair of in-ear earphones 12, 14. FIG. 1 is a cross section through the plane containing the ears' external auditory canals and the eyes and is viewed from above the head. In-ear earphone 12 is inserted into the external auditory canal of the person's left ear and in-ear earphone 14 is inserted into the external auditory canal of the person's right ear.

The in-ear earphones 12 and 14 are wireless earphones. Though their components are not shown in FIG. 1, each of the earphones 12 and 14 includes a transmitter, a receiver and an antenna so that it can transmit radio signals to, and receive radio signals from, the other earphone. These radio signals are used to establish a bi-directional Bluetooth® data link between the earphones 12 and 14 in the 2.4-2.5 GHz band. This data link can, amongst other things, be used for coordinating the timing of the sound signals that are emitted by the earphones 12 and 14 so that they work together to produce a desired stereo effect for the wearer. One of the earphones 12 and 14 will act as a master device and control the data link with the other earphone, though for the purposes of this discussion it does not matter which earphone is the master.

The earphones 12 and 14 are designed so that the radio signals that they produce to create the data link diffract as so-called "creeping waves" over the curved surface of the wearer's head 10 in order to interconnect the earphones 12 and 14. Moreover, the earphones 12 and 14 are designed so that they focus the signal power of the creeping waves along the path that connects earphones 12 and 14 over the back of the wearer's head. This path is designated 16 in FIG. 1. The aspects of the earphones 12 and 14 that allow this this specific mode of radio connection to be achieved will now be discussed. In this embodiment, the earphones 12 and 14 have the same design so, for the sake of brevity, only the structure and operation of earphone 14 will now be discussed, it being understood that the same description applies to earphone 12.

Figure 2:
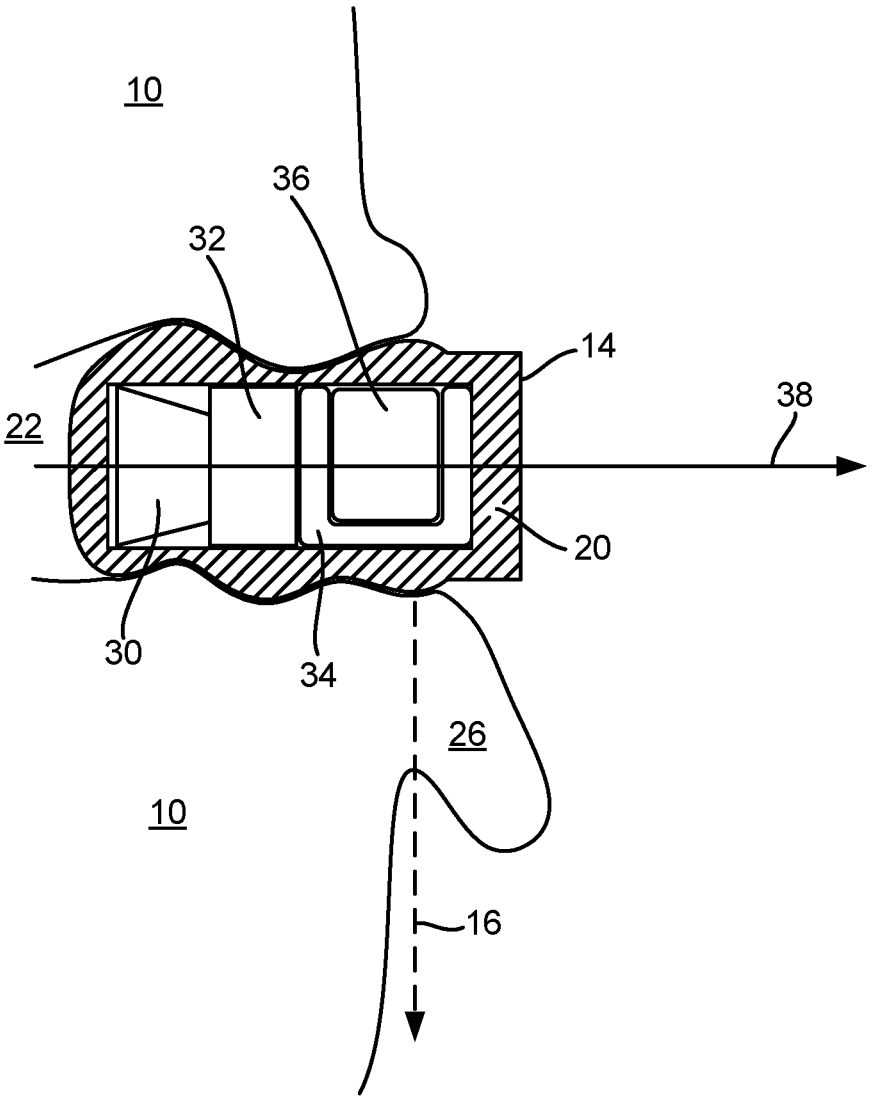
FIG. 2 is an enlargement of an area of FIG. 1.

FIG. 2 is an enlargement of the region within the dotted ring 18 in FIG. 1, and shows the cross section of the earphone 14 in greater detail, albeit still schematically. The earphone 14 has an outer casing 20 that is shown with shading in FIG. 2. The external surface of the casing 20 has special contours that are designed to fit the contours of the external auditory canal 22. The contours of the casing 20 are designed so that the earphone 14 only fits into (the outer part of) the external auditory canal 22 in one particular orientation. The components located within the casing 20, have a predetermined orientation with respect to the casing 20 and thus the contours of the housing 20 guarantee that the components within the housing 20 assume a particular orientation with respect to the wearer's head 10 when the earphone 14 is fitted into the external auditory canal 22. The contours that are provided on the outside of the casing 20 are therefore intended to orient the components within the earphone 14 correctly so that the creeping waves that are launched from the earphone 14 are focussed across the back of the wearer's head. More will be said of this orienting aspect later on.

FIG. 2 also shows, somewhat schematically, some components within the casing 20. These components are a loudspeaker 30, a microchip 32, a printed circuit board 34 and a button battery 36. The loudspeaker 30 transduces into sound electrical signals that are provided by the microchip 32. Printed circuit board 34 provides a support structure for, amongst other things, the microchip 32 and the loudspeaker 30. As shown in FIG. 2, the printed circuit board 34 conforms to, or is folded around, the button battery 36 that provides power for the earphone 14. As is usual, the button battery 36 is generally cylindrical and its exterior is largely made of metal (though, again as normal, its exterior is punctuated with insulating material).

Among other subsystems, the microchip 32 contains transmitter and receiver architectures, although these are not shown in FIG. 2. The receiver architecture is principally for the purpose of receiving and decoding wireless signals containing the sounds that the loudspeaker 30 is intended to reproduce. One of the main purposes of the transmitter architecture is to produce a signal for transmission in the creeping waves to establish the data link between the earphones 12 and 14 that is needed for stereo operation. The antenna that launches the creeping waves across the back of the wearer's head 10 is not shown in FIG. 2, although it is shown in later figures and will be described in detail in due course.

Arrow 38 in FIG. 2 indicates the direction normal to the surface of the head 10 at the location of the external auditory canal 22. It almost goes without saying that the surface to which arrow 38 indicates the normal direction is the surface of the head neglecting the external pinna 26. The relevance of arrow 38 will be made clear later on.

Figure 3:
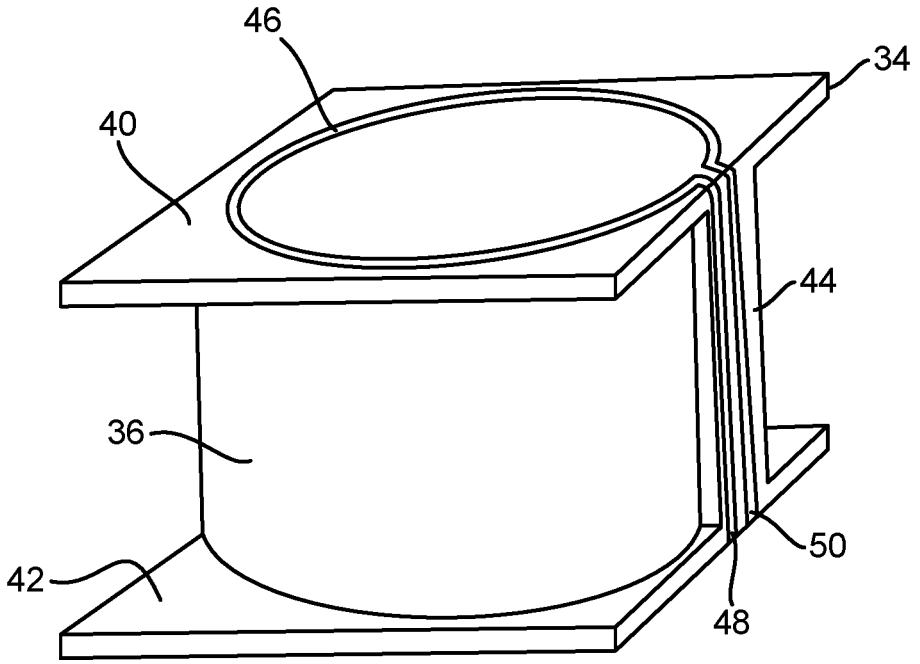
FIG. 3 is a perspective view of an arrangement of some components of a wireless earphone from FIGS. 1 and 2.

FIG. 3 is a perspective view of the earphone 14 in which components of the earphone 14 other than the printed circuit board 34 and the battery 36 have been omitted for clarity. The cylindrical nature of the button battery 36 is apparent in FIG. 3. The printed circuit board 34 has two rectangular portions 40 and 42 interconnected by a bridge 44. Rectangular portion 40 lies flush on one circular end face of the battery 36 and rectangular portion 42 lies flush on the opposite circular end face of the battery 36. The bridge 44 extends in flush contact with the curved surface of the cylindrical battery 36.

The printed circuit board 34 is flexible, at least in two regions, the first region being the boundary between rectangular section 42 and bridge 44 and the second region being the boundary between the bridge 44 and rectangular section 40. During the process of assembling the earphone 14, the printed circuit board 34 is presented flat, which is to say in an orientation with rectangular sections 40 and 42 and bridge 44 all extending in the same plane. During the process of assembling the earphone 14, the printed circuit board 34 is folded around the battery 36 in order to produce the compact and space-efficient structure shown in FIG. 3.

FIG. 3 also shows part of the antenna that is responsible for focussing the creeping waves around the back of the wearer's head 10. The part of the antenna that is visible in FIG. 3 is a conductive loop 46 that is printed on rectangular portion 40 of the printed circuit board 34. The elongated ends 48 and 50 of the loop 46 continue onto the bridge 44 as printed, conductive, straight, parallel tracks which then connect to a ground plane printed on the underside of rectangular section 42.

Figure 4:
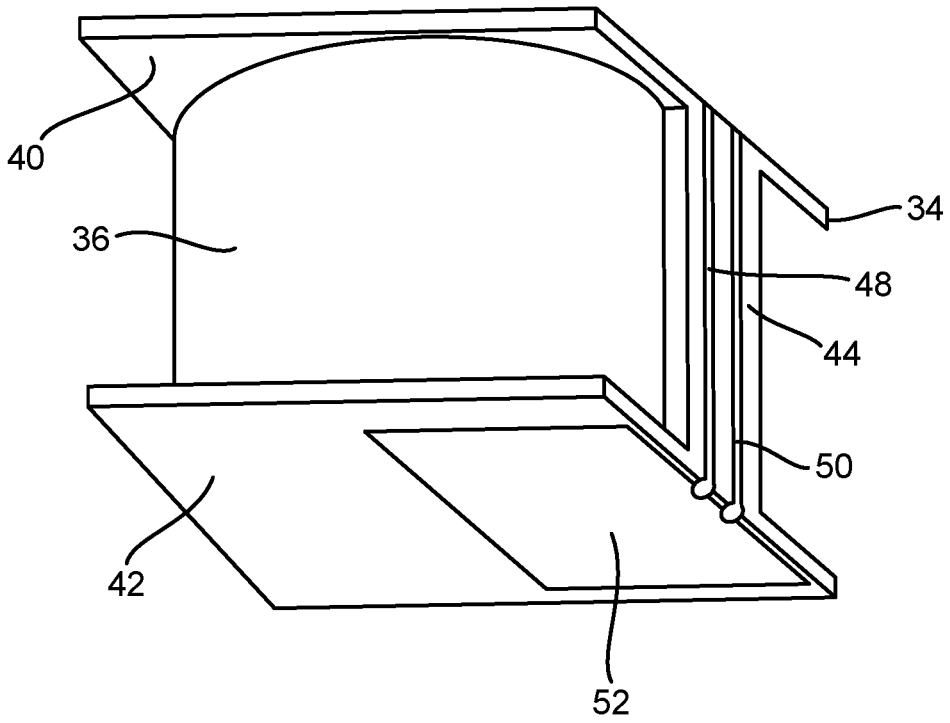
FIG. 4 shows the arrangement of FIG. 3 again, but from a different perspective to that used in FIG. 3.

FIG. 4 shows a different perspective view of the combination of the printed circuit board 34 and the battery 36 in which the underside of rectangular portion 42 can be seen. In FIG. 4, it can be seen that the parallel conductive tracks of elongated ends 48 and 50, which are really extensions of the ends of the conductive loop 46, reach and connect with a ground plane 52 on the underside of rectangular portion 42. Together, the ground plane 52, and the conductive loop 46 with its elongated, extended ends 48 and 50 constitute the antenna that is responsible for focussing the creeping waves across the back of the wearer's head 10.

In order for this antenna to transmit efficiently, the antenna is required to have a resonance at or close to the frequency of the Bluetooth® signal that it is to transmit around path 16. The frequency of this Bluetooth® signal can vary in a frequency band between 2.4 GHz and 2.5 GHz. Therefore, as a compromise, the antenna is, in the present embodiment, designed to resonate at a frequency of 2.5 GHz. Now, if one considers the case of a simple loop antenna without a ground plane, resonance occurs at a wavelength equal to the length of the loop. For a 2.5 GHz signal then, this would imply that the length of the loop would have to be approximately 120 mm, and it would be difficult to accommodate such a large antenna within an earphone designed for in-ear use.

If one instead considers a loop antenna with a ground plane, then the resonance occurs when the wavelength is twice the length of the loop. In other words, by adding a ground plane to the loop, one halves the length that the loop requires for resonant operation at a given frequency. In the case of the present embodiment, the antenna shown in FIGS. 3 and 4 is provided with ground plane 52 so that the length of the loop 46, including, it must be said, its elongated ends 48 and 50, can be selected to be equal to one half of the wavelength that corresponds to the desired resonant frequency of 2.5 GHz. In other words, the combined length of the loop 46 and elongated ends 48 and 50 is approximately 60 mm, which is a size that can be more easily accommodated within an in-ear earphone. Those conversant in the art will know that these dimensions are shortened when dielectric material such as plastics and human tissue are in proximity to the antenna elements.

The ground plane 52 cannot be very large because it must fit within the compact volume of the in-ear earphone 14. However, the smaller the ground plane is, the more the presence of the head 10 will tend to increase the impedance of, and in turn reduce the efficiency of, the antenna. Therefore, it is desirable to increase the effective size of the ground plane 52. This is achieved by mounting the ground plane 52 and the antenna close to the battery 34 so that there is capacitive coupling of current between, on the one hand, the metal exterior of the battery and, on the other hand, the antenna and the ground plane. The nature of these capacitively coupled currents will now be described in more detail with reference to FIG. 5.

Figure 5:
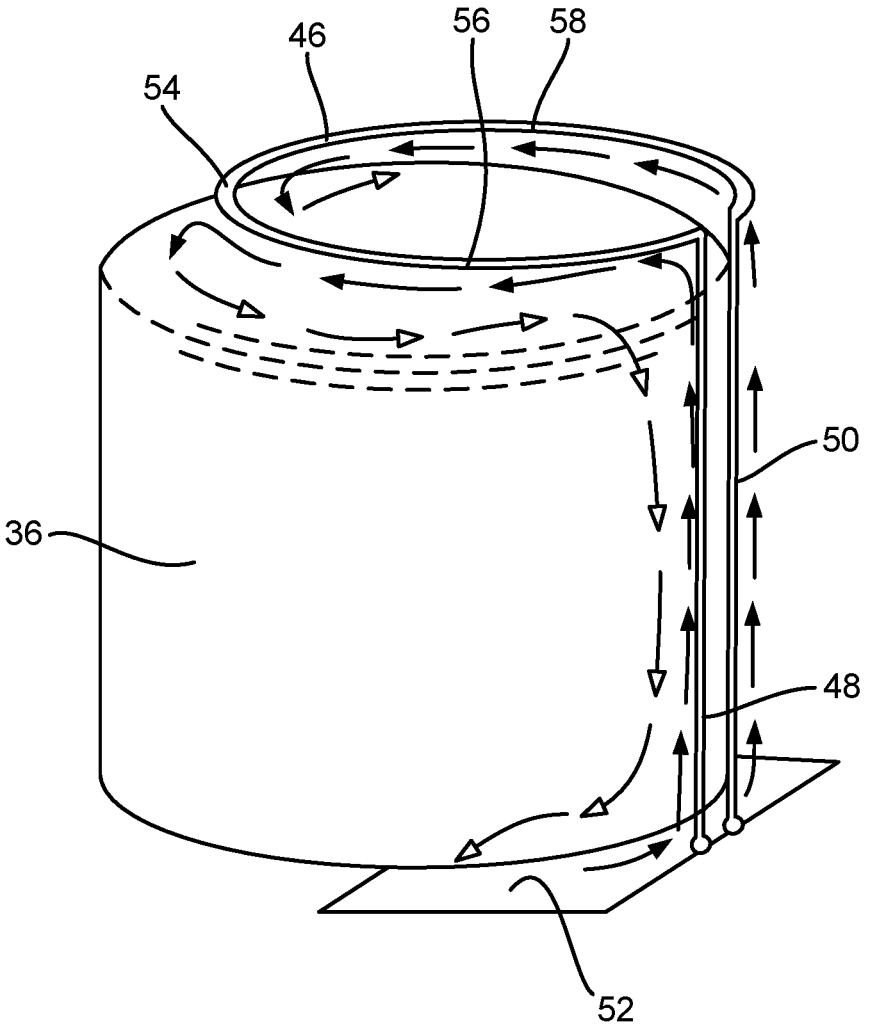
FIG. 5 is a further version of FIG. 3 in which the printed circuit board has been omitted for clarity.

FIG. 5 is a further perspective view of the assembly that is shown in FIGS. 3 and 4. In FIG. 5, the printed circuit board 34 has been omitted from the drawing, giving the impression that the antenna (comprised, it will be recalled, of the loop 46, its elongated ends 48 and 50, and the ground plane 52) is floating at a slight separation from the button battery 36. In practice, of course, it is the printed circuit board 34 that spaces the antenna from the battery 36. The reason for omitting the printed circuit board 34 from FIG. 5 is so that current flows in the antenna and in the surface of the battery 36 can be illustrated more easily. The arrows with solid heads denote current flow in the ground plane 52, in the elongated ends 48 and 50 of the loop and in the loop 46 itself. The arrows with open heads denote the path of current flow in the metallic surface of the battery 36.

In operation, the Bluetooth® signal that is to be transmitted along path 16 is applied to the antenna as a differential signal by the transmitter architecture in the microchip 32 via a port (not shown). The differential signal that is fed to the antenna is an a. c. signal and thus its waveform will normally exhibit both positive and negative voltages. The current flows shown in FIG. 5 are those that exist when the voltage of the Bluetooth® signal is positive. It will be understood that, when the voltage of the Bluetooth® signal is negative, the current flows run in the opposite direction.

In the state illustrated in FIG. 5, current flows from the ground plane 52 and up ends 48 and 50 in parallel. From the elongated ends 48 and 50, the current flows in parallel along both halves 56 and 58 of the loop 46 until it reaches the vicinity of point 54, which is a point on the loop 46 that is diametrically opposite the elongated ends 48 and 50. In the vicinity of point 54, the currents that are travelling in parallel along the two halves 56 and 58 of the loop 46 are capacitively coupled into the metallic surface of the battery 36, through which they commence a return journey to the ground plane 52. In FIG. 5, because of the perspective chosen for the drawing, only the return path for the current that travels through half 56 can be seen clearly. The return path for the current that travels through half 58 runs over the part of the curved surface of the battery 36 that is, from the viewer's perspective, at the back and hidden from view. Nonetheless, it can be assumed that the return path over the surface of the battery 36 for the current that travels through half 58 is substantially a mirror image of the return path that is taken by the current that travels through half 56.

As is apparent from FIG. 5, the return path across the surface of the battery 36 for the current that travels through half 56 runs along the edge of the upper circular face of the battery towards elongate end 48 and then down the battery to a point near the ground plane 52. At the bottom of the battery, the current that has returned over the surface of the battery 36 is capacitively coupled into the ground plane 52.

The skilled reader will, of course, appreciate that, in reality, the current flow in the surface of the battery will not be as precisely defined as it is shown to be in FIG. 5. In practice, there is a more widely spread current density within the surface of the battery 36; in other words, the open headed arrows are intended only to show the overall track of the returning current.

It should now be apparent that two current loops exist in FIG. 5: one loop for the current that travels via elongated end 48, loop half 56, the side wall of the battery 36 adjacent end 48 and the ground plane 52 and another loop for the current that travels via elongated end 50, loop half 58, the surface of the battery 36 adjacent the elongated end 50, and the ground plane 52. Furthermore, it should be apparent that these current loops are mirror images of one another and that the direction of current flow in both loops switches with each successive half cycle of the signal that is being transmitted from the antenna.

Earlier, the importance of giving the components of earphone 14 a particular orientation was mentioned. More specifically, it is important to give the antenna a particular orientation in order to optimise the power of the creeping waves that travel on path 16. In order for the waves emitted from the antenna to diffract or "creep" over the surface of the wearer's head 10, the waves emitted by the antenna need to have a polarisation in which their electric field vector is substantially parallel to the normal to the surface of the head at the site of the transmitter, i.e. the electric field vector needs to be parallel with arrow 38 in FIG. 2. This is achieved by arranging that the elongated ends 48 and 50, in which relatively high currents travel, run substantially parallel to the direction indicated by arrow 38 in FIG. 2. The creeping waves that diffract around the head are relatively weak, so the orientation of the antenna is also selected to enhance the strength of the creeping waves that travel along path 16. This is achieved by positioning the elongated ends 48 and 50 on the part of the curved side of the battery 36 that faces along path 16. Additionally, the closer together the elongated ends 48 and 50 are situated, the greater the strength of the creeping waves on path 16 will be. It is therefore preferred that the separation between the elongate ends 48 and 50, which, it will be recalled, are substantially parallel, is no more than 10% of the circumference of the cylindrical battery 36. In practical terms, in order to ensure that the creeping waves on path 16 have sufficient strength, it is preferred that the separation between the elongate ends 48 and 50 does not exceed 6 mm.

Figure 6:
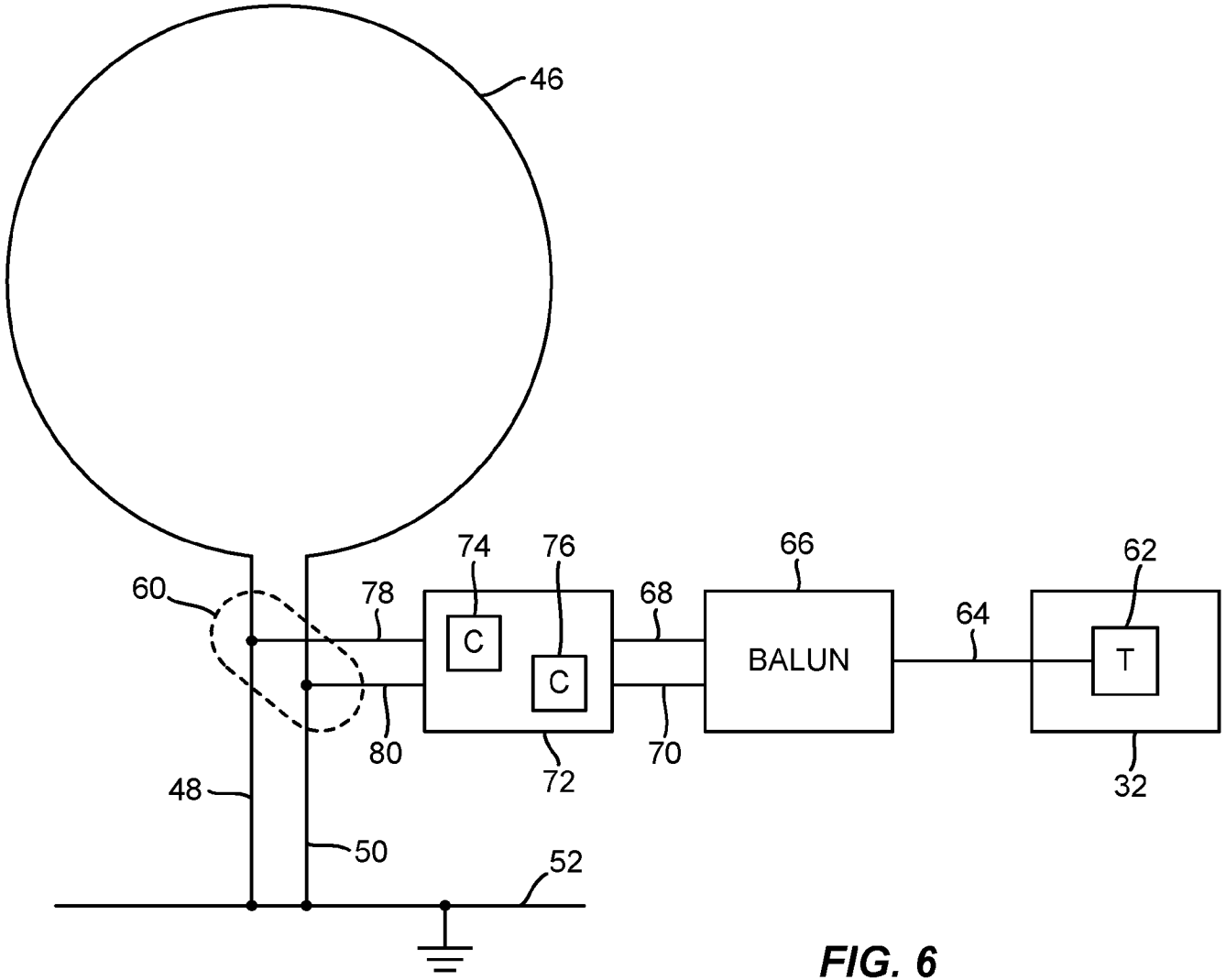
FIG. 6 is a schematic illustration of some of the circuitry within a wireless earphone from FIGS. 1 and 2.

FIG. 6 is a schematic illustration of the circuitry that is used to transmit signals from the antenna. In FIG. 6, the antenna is illustrated schematically in a flattened representation with the loop 46 terminating in ends 48 and 50 that extend to and connect with the ground plane 52. Also shown in FIG. 6 is a port 60 through which the signal to be transmitted is applied to the antenna. The signal processing chain that produces the signal that is applied to the antenna will now be described.

The microchip 32 that forms part of the earphone 14 is shown in FIG. 6. Moreover, FIG. 6 shows the transmitter architecture 62 within the microchip 32 that develops the Bluetooth® signal that is to be transmitted from the antenna in the creeping waves. The signal produced by the transmitter 62 is delivered over connection 64 to a balun 66. The balun 66 converts the signal from the transmitter architecture 62 into a differential signal that is delivered over connections 68 and 70 to impedance matching network 72. The differential signal that is to be transmitted is delivered from the impedance matching network 72 over connections 78 and 80 which are connected to respective ones of elongated ends 48 and 50 to create the port 60.

The purpose of the impedance matching network 72 is to improve the electrical efficiency of the antenna by ameliorating the undesirable reflection from the antenna of the differential signal that the balun 66 sends to the antenna. In matching network 72, capacitors are the only reactive components used. By using only capacitors in impedance matching network 72, the resistive loss that would be associated with the use of inductors is avoided. Since the earphone 14 has to be compact to fit in the ear, area-intensive-printed structures are not suitable for implementing the impedance matching network 72. Accordingly, the capacitors used within the impedance matching network 72 are discrete components, which are otherwise known as lumped components. Two capacitors 74 and 76 are schematically illustrated within the impedance matching network 72.

While many variations of the earphones 12 and 14 can be conceived, certain variants will now be highlighted.

In the embodiment discussed with respect to FIGS. 3 and 4, the printed circuit board 34 was said to be flexible and folded around the battery 36 during manufacture. In another embodiment, the printed circuit board 34 is rigid and is manufactured in the shape shown in FIG. 3 and the battery 36 is slotted into the pincer-like form of the printed circuit board. Additionally, it is of course not necessary for the portions 40 and 42 to be rectangular. In order to reduce the size of the earphones 12 and 14, for example, it might be useful for the portions 40 and 42 to be circular and matched in size to their respective faces of the battery 36.

Figure 7:
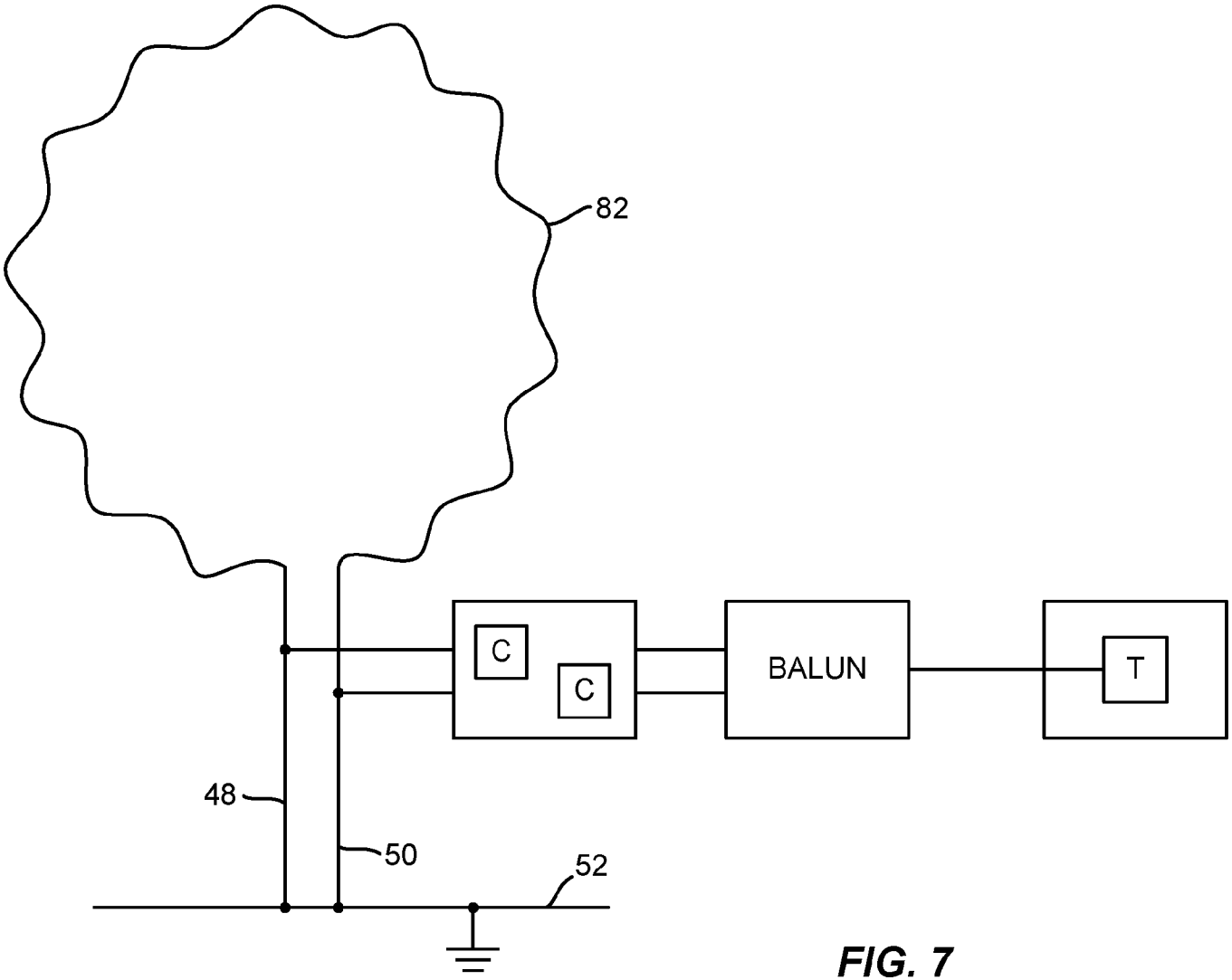
FIG. 7 is a schematic illustration of a variant of the circuitry in FIG. 6 in which the geometry of the antenna loop has been changed.
Figure 8:
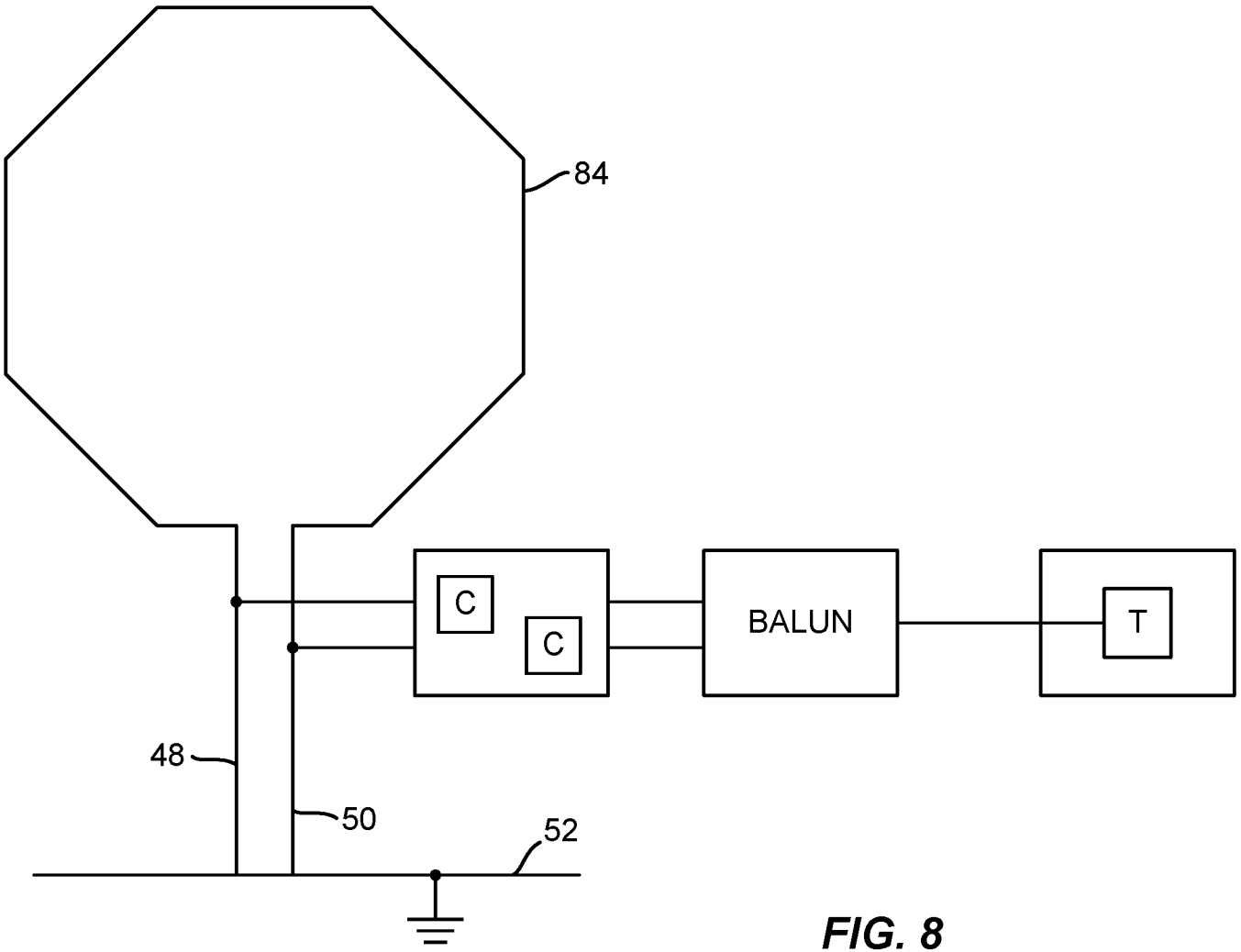
FIG. 8 is a schematic illustration of another variant of the circuitry in FIG. 6 in which the geometry of the antenna loop has been changed in a different way.
Figure 9:
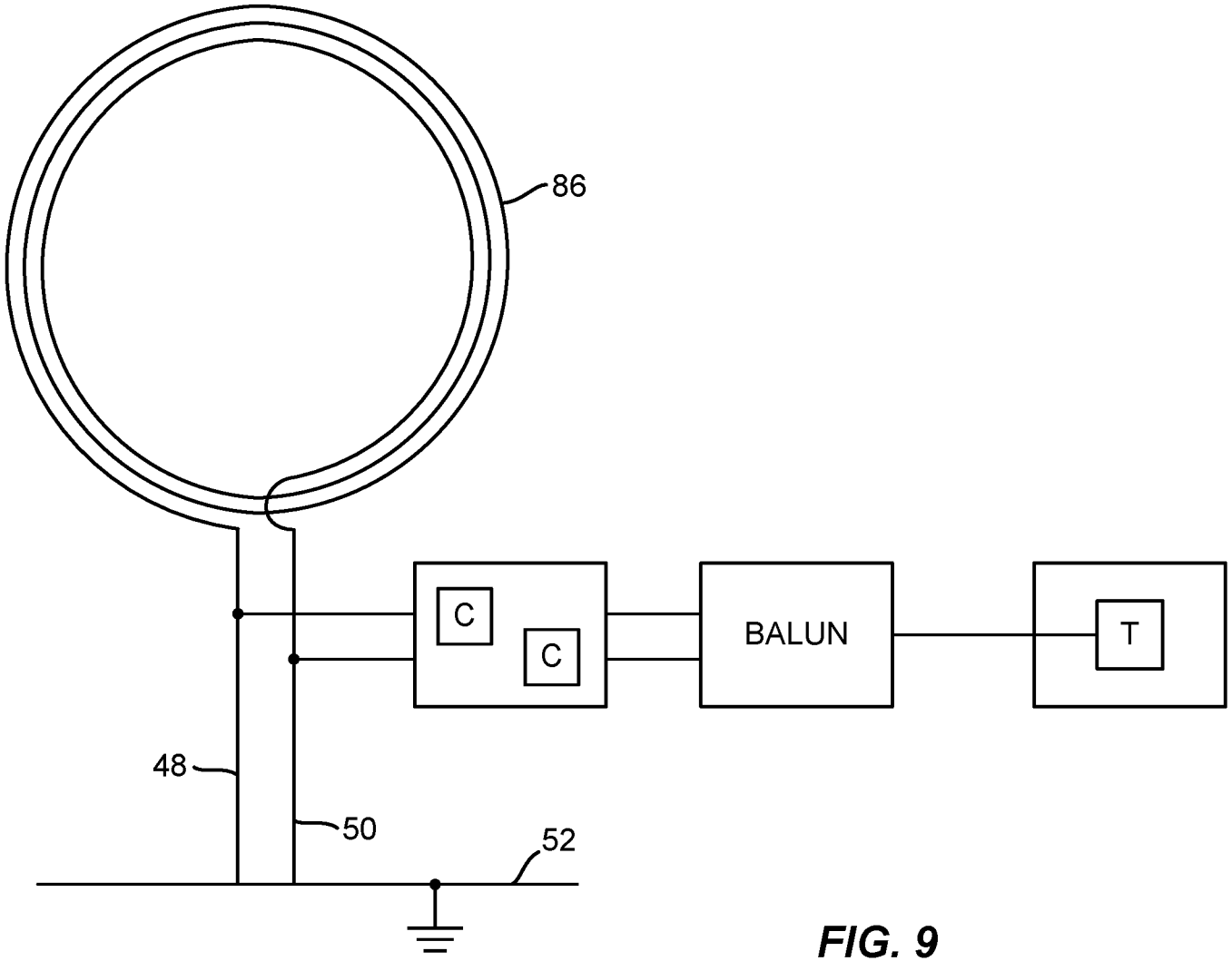
FIG. 9 is a schematic illustration of a further variant of the circuitry in FIG. 6 in which the geometry of the antenna loop has been changed in yet a different way.

In the embodiment discussed with reference to FIGS. 3 to 6, the loop 46 is a smooth circular loop. However, it is not necessary that the loop has that exact geometry. FIGS. 7 to 9 are variants of FIG. 6 in which the smooth circular loop 46 has been replaced with a loop having a different geometry. In FIG. 7, the loop, now indicated 82, follows a meandering path which nonetheless remains generally circular. In FIG. 8, the loop, now indicated 84, has the shape of an irregular heptagon. Of course, the loop could follow the shape of a different polygon if desired. In FIG. 9, the loop, now indicated 86, takes the form of a spiral. In FIG. 9, the spiral has three turns, though in practice a different number of turns could of course be used. Effectively, a spiral, when its turns are closely spaced, acts like a single loop but with a wider conductor. It should now be apparent to the skilled person that wide variation in the geometry and layout of the loop is possible.

In the embodiment that was discussed with reference to FIGS. 2 to 5 in particular, the battery 36 has a metal exterior which is exploited as a return path for current flow in the antenna. However, it need not be the case that the exterior of the battery is metallic; it suffices merely that the battery has a conductive shell sufficiently close to its exterior for appreciable current to be capacitively coupled between the antenna loop and the shell and between the shell and the ground plane.

Similarly, it is also envisaged that the battery 36 could be given a thin coating of an electrically insulating material such that when the capacitively coupled current flows over the battery, it could be said, arguably, that the current does not flow over the exterior of the battery since the current is flowing beneath the coating.

Figure 10:
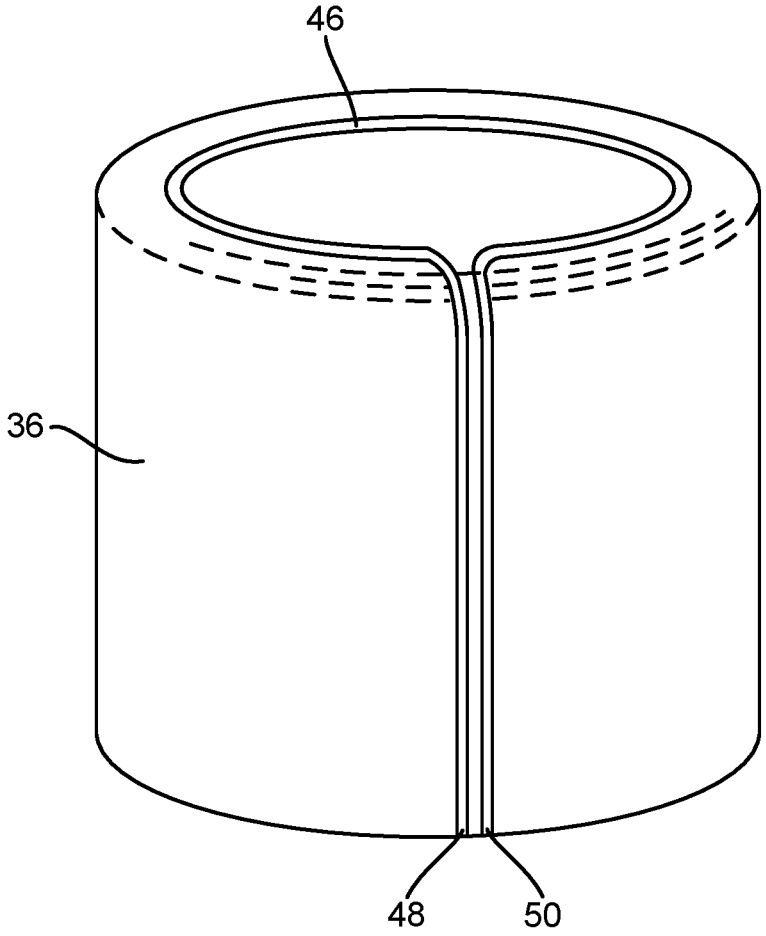
FIG. 10 is a perspective view of an arrangement of some components in another embodiment of the wireless earphone from FIGS. 1 and 2.
Figure 11:
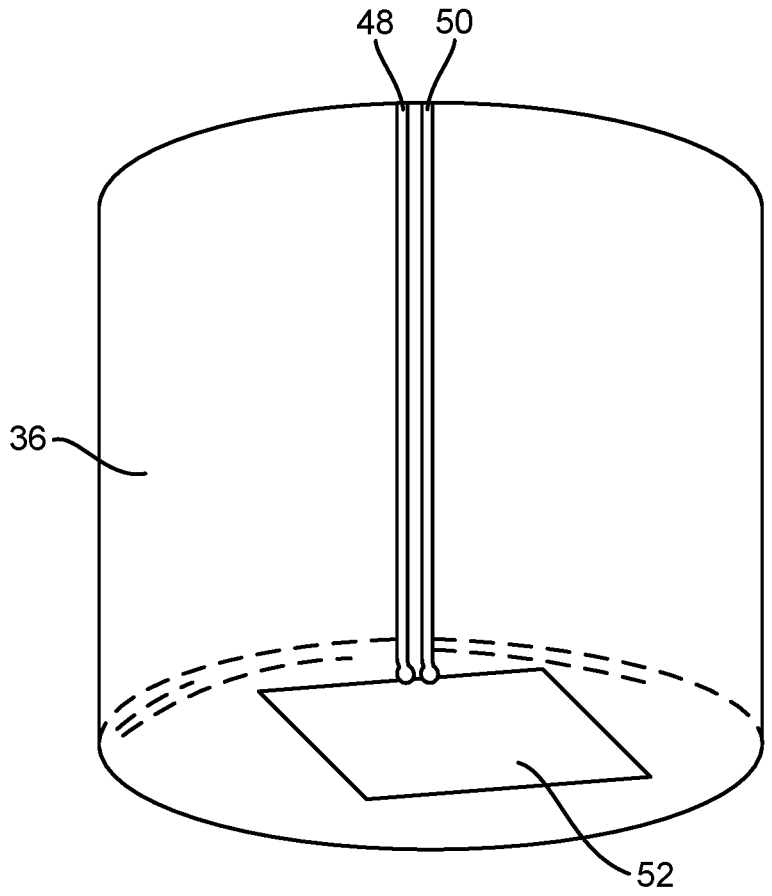
FIG. 11 shows the arrangement of FIG. 10 again, but from a different perspective to that used in FIG. 10.

An extension of the idea of applying an electrically insulating coating to at least parts of the battery 36 leads to a further embodiment that will now be described with reference to FIGS. 10 and 11. FIG. 10 shows a perspective view of the battery 36 according to this embodiment. In this embodiment, the loop 46, its extended elongated ends 48 and 50 and the ground plane 52 are applied to the battery without the use of an intervening printed circuit board. By eliminating the printed circuit board, the device is even more space efficient. In order to prevent a short circuit between the metal exterior of the battery 36 and the antenna, however, at least the parts of the exterior of the battery 36 that underlie the loop 46, its elongated ends 48 and 50 and the ground plane 52 are coated with an electrically insulating material. FIG. 11 shows the embodiment of FIG. 10 from a different perspective so that the ground plane 52 can be seen on the lower surface of the battery 36.

Embodiments have now been described in which the antenna is mounted on the battery (FIGS. 10 and 11) and in which the antenna is mounted on a printed circuit board which, in turn, is mounted on the battery (FIGS. 3 and 4). It is of course possible to mount the antenna on some other kind of support structure provided that the antenna is sufficiently close to the battery to capacitively couple appreciable current into a conductive part (typically the exterior) of the battery.

The invention claimed is:

1. A wireless earphone comprising:

a mount:

an antenna including a ground plane and including a loop having first and second ends extending to, and connected to, the ground plane; and a battery including a conductive shell, a first face, a second face opposed to the first face, and a side connecting the first and second faces, wherein:

the antenna is folded around the battery such that the loop extends over the first face of the battery, the ground plane extends over the second face of the battery, and the first and second ends extend over the side of the battery to connect the loop with the ground plane, and the mount is configured to locate the wireless earphone on a wearer's head in a particular orientation in which the first and second ends of the loop run over a part of the side that faces towards the wearer's other ear across the back of the wearer's head.

2. The wireless earphone of claim 1, further comprising a circuit board on which the antenna is carried.

3. The wireless earphone of claim 2, wherein the circuit board comprises a first portion supporting the loop, a second portion supporting the ground plane, and a bridge connecting the first and second portions and supporting the first and second ends.

4. The wireless earphone of claim 3, wherein the circuit board includes a first boundary between the first portion and the bridge and includes a second boundary between the bridge and the second portion.

5. The wireless earphone of claim 4, wherein the circuit board is flexible at least at the first and second boundaries.

6. The wireless earphone of claim 1, wherein the loop extends between the first and second ends in a smooth circular path.

7. The wireless earphone of claim 1, wherein the loop extends between the first and second ends in a path that meanders locally but which is circular overall.

8. The wireless earphone of claim 1, wherein the loop extends between the first and second ends in a spiral path.

9. The wireless earphone of claim 1, wherein the conductive shell forms a part of an exterior of the battery.

10. The wireless earphone of claim 1, further comprising:

a transmitter coupled to the antenna and configured to transmit a signal from the antenna, wherein a length of the loop including the first and second ends is substantially the same as one half of a wavelength of a carrier wave in the signal.

11. The wireless earphone of claim 1, further comprising:

a matching network including one or more reactive elements; and a transmitter coupled to the antenna via the matching network and configured to transmit a signal from the antenna.

12. The wireless earphone of claim 11, wherein each of the one or more reactive elements comprises a lumped capacitor.

13. The wireless earphone of claim 1, wherein the mount is shaped to fit against the wearer's ear in only the particular orientation.

14. The wireless earphone of claim 13, wherein the mount is shaped to fit in the ear and not around the outside of the ear.

15. The wireless earphone of claim 1, wherein a separation between the first and second ends, as they extend over the side of the battery, does not exceed 6 mm.

16. The wireless earphone of claim 1, wherein the mount is shaped to fit against the wearer's ear in only the particular orientation.

17. The wireless earphone of claim 16, wherein the mount is shaped to fit in the ear and not around the outside of the ear.

* * * * *